US009091134B2

(12) United States Patent
Vick

(10) Patent No.: US 9,091,134 B2
(45) Date of Patent: Jul. 28, 2015

(54) EXPENDABLE MECHANICAL RELEASE PACKER PLUG FOR HEAVY MUD

(71) Applicant: Michael Lee Vick, Carrollton, TX (US)

(72) Inventor: Michael Lee Vick, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 294 days.

(21) Appl. No.: 13/622,848

(22) Filed: Sep. 19, 2012

(65) Prior Publication Data

US 2014/0076584 A1 Mar. 20, 2014

(51) Int. Cl.
*E21B 27/00* (2006.01)
*E21B 33/12* (2006.01)
*E21B 33/134* (2006.01)

(52) U.S. Cl.
CPC ..... *E21B 27/00* (2013.01); *E21B 33/12* (2013.01); *E21B 33/134* (2013.01)

(58) Field of Classification Search
CPC ..... E21B 33/12; E21B 33/129; E21B 33/13; E21B 33/134; E21B 33/1216; E21B 33/1208; E21B 27/00; E21B 23/06
USPC ..... 166/179, 187, 185, 387, 202, 121, 142, 166/264, 134, 138, 149
See application file for complete search history.

(56) References Cited

U.S. PATENT DOCUMENTS 2,626,177 A * 1/1953 Maxwell et al. ..... 294/86.11
2,874,781 A * 2/1959 McGaffey ..... 166/167

* cited by examiner

*Primary Examiner* — Yong-Suk (Philip) Ro
(74) *Attorney, Agent, or Firm* — Scott Richardson; Baker Botts L.L.P.

(57) ABSTRACT

An apparatus and method for plugging a well during subterranean operations is disclosed. Specifically, a mechanical release packer plug assembly is disclosed. The mechanical release packer plug assembly includes a debris chamber and is releasably engaged with a packer of a suitable packer assembly.

19 Claims, 1 Drawing Sheet

EXPENDABLE MECHANICAL RELEASE PACKER PLUG FOR HEAVY MUD

BACKGROUND

In the course of treating and preparing subterranean wells for production, a downhole packer may be run into the well on a work string or a production tubing. Packers are suspended in the wellbore, or in a casing in the wellbore, from a tubing string, or the like, and are activated, or set, so that one or more packer elements engage the inner surface of the wellbore or casing. The purpose of the packer is to support production tubing and other completion equipment, and to seal the annulus between the outside of the production tubing and the inside of the well casing to block movement of fluids through the annulus past the packer location.

Packer setting methods may be classified as mechanical, hydraulic, or electric. Hydraulic methods include both hydraulically setting with surface pressure or hydrostatically setting with well pressure. Hydraulically setting a packer may refer to applying fluid pressure to the tubing, which then may be translated to a plugging device below the packer. Hydrostatically setting a packer may refer to relying on the downhole well pressure for setting and applying tubing and/or casing pressure on the packer to release hydrostatic pressure.

The process of perforating and fracturing is a well-known method of increasing production of a well. Packers may be used to isolate a designated zone of a wellbore before perforating or fracturing the well. The process of fracturing the well generally produces debris within the wellbore. Some of this debris may be removed from the wellbore by reverse circulation of the well fluids. However, reverse circulation cannot remove all debris from the wellbore, and some well configuration may increase the difficulty in removing the debris via reverse circulation. Thus, it may be desirable to provide a tool adapted to collect debris below the packer so that the debris does not interfere with the other downhole operations. Expendable plug mechanisms may be used as a temporary barrier between perforations and the surface, or as a temporary bridge plug in the setting of a hydraulic packer. Some prior art expendable plugs rely on pressure differentials above and below the plug to expend the plug. Prior art plug mechanisms may include, but are not limited to, pump out plugs, expendable plugs, and pump-thru plugs. A pump-out plug and pump-thru plug may be expended by dropping a ball from the surface and applying pressure above the ball when it is on the seat of the plug. When the pressure from above exceeds the shear rating of shear pins holding the plug in place, the internal plug shears out. An expendable plug may be expended when a piston in the plug is mechanical shifted downward thereby unsupporting lugs used to latch the plug onto the packer.

One problem associated with such prior art expendable plugs is that debris within the wellbore may inhibit the function of the expendable plug mechanisms. Thus, as stated above, it may be desirable to provide a tool adapted to collect debris below the packer so that the debris does not interfere with the other downhole operations. Another problem associated with such prior art plugs is that the shear pin rating required to expend the plug mechanism may result in hydrostatic pressures that may exceed the pressure rating of other equipment used in the completion. Thus, it may be desirable to provide a locking mechanism for attaching the plug to the packer that may be disengaged or unlocked upon interaction with a downhole tool. Another problem associated with such prior art expendable plug mechanisms is the possibility of the plug expending prematurely. Thus, it may also be desirable to adapt a plug mechanism to be releasably engaged and only disengaged upon interaction with the downhole tool.

SUMMARY OF THE INVENTION

The present invention relates generally to downhole packer plugs used in wellbores, and more particularly, in certain embodiments, to an expendable mechanical release packer plug assembly for use in completions. The present invention finds particular application in completions that use heavy mud for completion fluids.

In one exemplary embodiment, the present disclosure is directed to a mechanical release packer plug assembly comprising: a housing having a bore therethrough; an inner sleeve disposed within the housing having a bore therethrough; a bottom sub having a bore therethrough and coupled to a lower end of the housing; a debris chamber with a bore therethrough coupled at an upper end to a lower end of the bottom sub; and an end cap coupled to a lower end of the debris chamber.

In another exemplary embodiment, the present disclosure is directed to a hydraulic set packer assembly for use in subterranean operations comprising: a packer comprising a top sub, bottom sub, and a bore therethrough, the bottom sub further comprising a collet; a mechanical release packer plug assembly comprising: a housing having a bore therethrough; an inner sleeve disposed within the housing having a bore therethrough; a bottom sub having a bore therethrough and coupled to a lower end of the housing; a debris chamber with a bore therethrough coupled at an upper end to a lower end of the bottom sub; and an end cap coupled to a lower end of the debris chamber; wherein an upper end of the inner sleeve is releasably engaged with the collet thereby connecting the bottom sub of the packer to the mechanical release packer plug assembly; and wherein a lower end of the packer bottom sub is sealingly engaged with an inner profile of the inner sleeve by a seal.

In yet another exemplary embodiment, the present disclosure is directed to a method of plugging a well during subterranean operations comprising: hydraulically setting a hydraulic set packer assembly in a well bore, the hydraulic set packer assembly comprising: a packer comprising a top sub, bottom sub, and a bore therethrough, the bottom sub further comprising a collet; a mechanical release packer plug assembly comprising: a housing having a bore therethrough; an inner sleeve disposed within the housing having a bore therethrough; a bottom sub having a bore therethrough and coupled to a lower end of the housing; a debris chamber with a bore therethrough coupled at an upper end to the lower end of the bottom sub; and an end cap coupled to a lower end of the debris chamber; wherein an upper end of the inner sleeve is releasably engaged with the collet thereby connecting the bottom sub of the packer to the mechanical release packer plug assembly; and releasing the mechanical release packer plug assembly from the packer by disengaging the inner sleeve from the collet.

The features and advantages of the present invention will be readily apparent to those skilled in the art. While those skilled in the art may make numerous changes, such changes are within the spirit of the invention.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and are not exhaustive of the scope of the disclosure.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

The terms "couple" or "couples" as used herein are intended to mean either an indirect or direct connection. Thus, if a first device couples to a second device, that connection may be through a direct connection, or through an indirect mechanical or electrical connection via other devices and connections. The term "downhole" as used herein means along the drill string or the hole from the surface towards the distal end.

The present invention relates generally to downhole packer plugs used in wellbores, and more particularly, in certain embodiments, to an expendable mechanical release packer plug for use in completions that use heavy mud for completion fluids.

Figure 1:
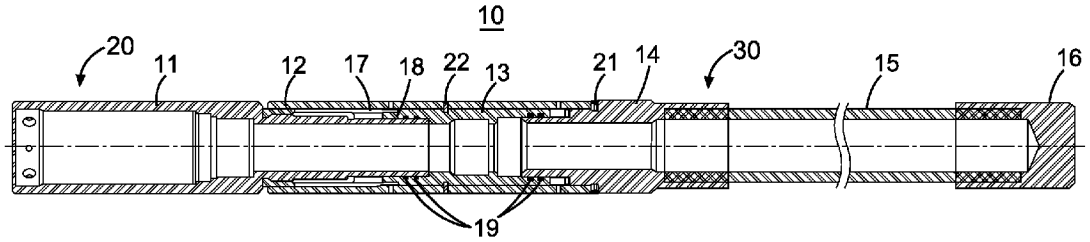
FIG. 1 illustrates a cross-sectional view of a hydraulic set packer assembly comprising a mechanical release packer plug assembly in a run-in-hole configuration, in accordance with certain embodiments of the present disclosure.

Referring to FIG. 1, a hydraulic set packer assembly in accordance with an illustrative embodiment of the present disclosure is denoted generally with reference numeral 10. The hydraulic set packer assembly 10 may be located within a wellbore (not shown). FIG. 1 shows the hydraulic set packer assembly 10 in a run-in-hole configuration, in accordance with certain embodiments of the present disclosure. In certain embodiments, the hydraulic set packer assembly 10 may include a packer, denoted generally with reference numeral 20. The packer 20 may include a top sub (not shown), a bottom sub 11, and a bore therethrough. The bottom sub 11 of the packer 20 may further include a collet 17.

The hydraulic set packer assembly 10 may further include a mechanical release packer plug assembly, denoted generally with reference numeral 30. Although the illustrative embodiment of the Figures depicts the mechanical release packer plug assembly 30 as part of the hydraulic set packer assembly 10, the present disclosure is not limited to this particular embodiment. The mechanical release packer plug assembly 30 may be part of any suitable packer assembly, as would be appreciated by those of ordinary skill in the art. The mechanical release packer plug assembly 30 may include a housing 12 having a bore therethrough. The mechanical release packer plug assembly 30 may further include an inner sleeve 13 having a bore therethrough. The inner sleeve 13 may be disposed within the housing 12. The mechanical release packer plug assembly 30 may further include a bottom sub 14 having a bore therethrough. The bottom sub 14 may be coupled to the housing 12. In certain embodiments, the bottom sub 14 may be coupled to a lower end of the housing 12. As shown in FIG. 1, the bottom sub 14 may be coupled to the housing 12 via a connecting means 21. Any connecting means known to those of ordinary skill in the art may be used to couple the bottom sub 14 to the housing 12. For instance, the connecting means may include, but are not limited to one or more set screws. The Figures show the bottom sub 14 coupled to the housing 12 by one or more set screws 21. However, those skilled in the art will appreciate other suitable configurations.

In certain embodiments, the bottom sub 14 may also be sealingly engaged with an inner profile of the inner sleeve 13 by a seal 19. Any seal known to those of ordinary skill in the art may be used to sealingly engage the bottom sub 14 with the inner profile of the inner sleeve 13. For instance, the seal may be, but is not limited to one or more elastomeric o-rings 19. The Figures show the bottom sub 14 coupled to the inner sleeve 13 by one or more elastomeric o-rings 19. However, those skilled in the art will appreciate other suitable configurations.

The mechanical release packer plug assembly 30 may further include a debris chamber 15 having a bore therethrough. The debris chamber 15 may provide a receptacle for fluid and other debris to accumulate below the mechanical release packer plug assembly 30. In this manner, the debris chamber 15 may be adapted to prevent fluid and other debris from interfering with subterranean operations. The debris chamber 15 may be coupled to the bottom sub 14. In certain embodiments, an upper end of the debris chamber 15 may be coupled to a lower end of the bottom sub 14. The mechanical release packer plug assembly 30 may further include an end cap 16 coupled to the debris chamber 15. In certain embodiments, the end cap 16 may be coupled to a lower end of the debris chamber 15.

As shown in FIG. 1, an upper end 18 the inner sleeve 13 of the mechanical release packer plug assembly 30 may be releasably engaged with the collet 17 of the packer bottom sub 11. In this manner, the packer bottom sub 11 may be coupled to the mechanical release packer plug assembly 30. Although the illustrative embodiment of the Figures depicts the mechanical release packer plug assembly 30 engaged with the packer 20 of the hydraulic set packer assembly 10, the present disclosure is not limited to this particular embodiment. The mechanical release packer plug assembly 30 may be engaged with any suitable packer, as would be appreciated by those of ordinary skill in the art.

In certain embodiments, a lower end of the packer bottom sub 11 may be sealingly engaged with the inner profile of the inner sleeve 13 by a seal 19. Any seal known to those of ordinary skill in the art may be used to sealingly engage the packer bottom sub 11 with the inner profile of the inner sleeve 13. For instance, the seal may be, but is not limited to one or more elastomeric o-rings 19. The Figures show the packer bottom sub 11 coupled to the inner sleeve 13 by one or more elastomeric o-rings 19. However, those skilled in the art will appreciate other suitable configurations.

As further shown in FIG. 1, one or more shear pins 22 may releasably secure the inner sleeve 13 to the housing 12. In certain embodiments, the shear pins 22 may serve as an aid during assembly. In certain embodiments, the shear pins 22 may help insure that the inner sleeve 13 is in suitable position to support collet 17. In certain embodiments, the one or more shear pins 22 may be adapted to prevent longitudinal motion between the housing 12 and the inner sleeve 13 until the one or more shear pins 22 are sheared. The one or more shear pins may be sheared when the upper end 18 of the inner sleeve 13 disengages from the collet 17 of the packer 20, as explained below in reference to FIG. 2.

In accordance with certain embodiments of the present disclosure, the hydraulic set packer assembly 10 may be run into the well on a work string or a production tubing (not shown) and may be hydraulically set in a well bore (not shown). Hydraulically setting a packer may refer to applying fluid pressure to the tubing, which then may be translated to a plugging device below the packer. Prior to the setting of the hydraulic set packer assembly 10, a heavy completion fluid (not shown) may be run into to the well. Thus, in accordance with certain embodiments of the present disclosure, the hydraulic set packer assembly 10 may be lowered and set in the heavy completion fluid (not shown) in the wellbore (not shown). In certain embodiments, a hydrostatic pressure created by the heavy completion fluid is slightly over balance—that is, a pressure created by the weight of the fluid is higher than a pressure in the well. Once the hydraulic set packer assembly 10 is set, the heavy completion fluid (not shown) may be displaced with a lighter completion fluid (not shown). One or more fluid displacements may occur.

Further in accordance with certain embodiments of the present disclosure, a second packer (not shown) may be run on a work string or a production tubing (not shown) and may be hydrostatically set in a well bore (not shown), above the packer 20 of the hydraulic set packer assembly 10. The second packer (not shown) may be coupled to an upper end of the top sub of the packer 20 of the hydraulic set packer assembly 10 by a latching mechanism (not shown). Hydrostatically setting a packer may refer to relying on the downhole well pressure for setting and applying tubing and/or casing pressure on the packer to release hydrostatic pressure.

Figure 2:
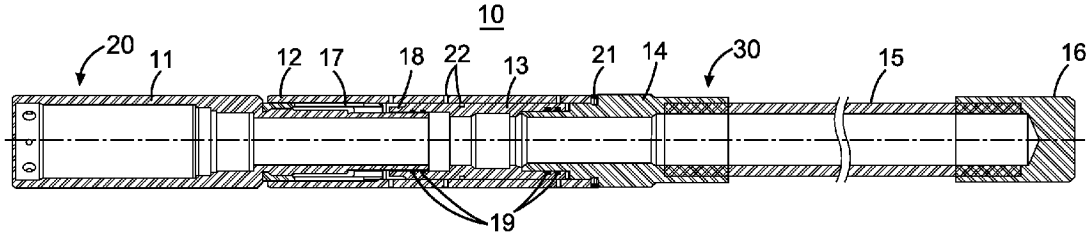
FIG. 2 illustrates a cross-sectional view of a hydraulic set packer assembly comprising a mechanical release packer plug assembly in a released configuration, in accordance with certain embodiments of the present disclosure.

Referring now to FIG. 2, a shifting tool (not shown) may be attached to a wireline tool and run, via conventional wire-line methods, through the inner sleeve 13 of the mechanical release packer plug assembly 30. The inner dimensions of the inner sleeve 13 may be adapted to mate with the outer dimensions of the shifting tool (not shown). The inner dimensions of the bottom sub 14 may also be adapted to mate with the outer dimensions of the shifting tool (not shown). The shifting tool (not shown) may have retractable keys (not shown). The retractable keys (not shown) may be adapted to fit within the inner profile of the inner sleeve 13. The shifting tool (not shown) may be activated downhole, within the inner sleeve 13, causing the inner sleeve 13 to shift downward. A downward shift of the shifting tool (not shown) may cause the upper end 18 of the inner sleeve 13 to disengage from the collet 17 of the packer 20, as shown in FIG. 2. When the shifting tool is shifted downward, the retractable keys (not shown) may be adapted to retract once they engage with the inner profile of the bottom sub 14, thereby allowing the shifting tool (not shown) to push through the inner sleeve 13 and bottom sub 14. Once the keys (not shown) are retracted, the shifting tool (not shown) may be adapted to give a positive indication at the surface that the inner sleeve 13 has been fully shifted. The shifting tool (not shown) may also include shear pins (not shown). The shear rating of the shear pins installed in the shifting tool may be more than the shear rating of the shear pins 22 used to releasably secure the inner sleeve 13 to the housing 12, as shown in FIG. 1.

Figure 3:
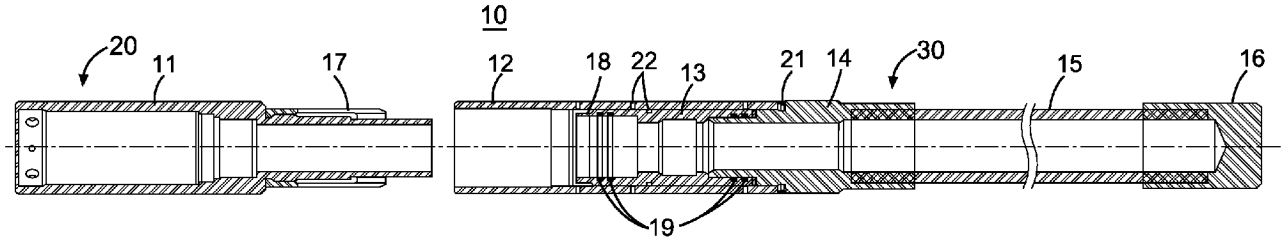
FIG. 3 illustrates a cross-sectional view of a hydraulic set packer assembly comprising a mechanical release packer plug assembly in an expended configuration, in accordance with certain embodiments of the present disclosure.

Referring now to FIG. 3, in certain embodiments of the present disclosure, once the upper end 18 of the inner sleeve 13 has been disengaged from the collet 17, surface tubing pressure may be applied to cause a pressure differential above and below the mechanical release packer plug assembly 30. When the pressure above the mechanical release packer plug assembly 30 exceeds the pressure below the mechanical release packer plug assembly 30, a friction in the seal 19 between bottom sub 11 of the packer 20 and the inner profile of the inner sleeve 13 may be reduced. In certain embodiments, when the friction in the seal 19 is reduced, the mechanical release packer plug assembly 30 may be released from the bottom sub 11 of packer 20. In this manner, the mechanical release packer plug assembly 30 may be expended from the packer 20, as illustrated in FIG. 3, and fall to the bottom of the wellbore (not shown).

In an embodiment as illustrated, the mechanical release packer plug assembly 30 may not be expended from the packer 20 until the inner sleeve 13 is shifted downward. In this manner, certain embodiments in accordance with the present disclosure prevent premature expending of the mechanical release packer plug assembly 30.

Moreover, as would be appreciated by those of ordinary skill in the art having the benefit of this disclosure, the mechanical release packer plug assembly 30 may be an integral part of the hydraulic set packer assembly 10. In other embodiments in accordance with the present disclosure, the mechanical release packer plug assembly 30 may be part of any suitable packer assembly, as would be appreciated by those of ordinary skill in the art. In yet other embodiments in accordance with the present disclosure, the mechanical release packer plug assembly 30 may be adapted to be coupled directly to a tubing connection (not shown).

Using the methods of certain embodiments of the present disclosure, the debris chamber 15 of the mechanical release packer plug assembly 30 may allow for fluids and other debris to accumulate below the mechanical release packer plug assembly 30. Thus, unlike packer plugs that do not utilize a debris chamber in accordance with the present disclosure, the debris chamber 15 may be adapted to prevent debris from interfering with the subterranean operations, including running the shifting tool (not shown) downhole via conventional wire-line methods.

As would be appreciated by those of ordinary skill in the art, with the benefit of this disclosure, the mechanical release packer plug assembly 30 in accordance with embodiments of the present disclosure may be adapted for use in completions that use heavy mud for completion fluid. Further, as would be appreciated by those of ordinary skill in the art, with the benefit of this disclosure, without the use of a shifting tool (not shown) activated downhole by conventional wire-line methods, the mechanical release packer plug assembly 30 cannot be expended. That is, the mechanical release packer plug assembly 30 may not be expended by a pressure differential in the well. In this manner, premature expending of the mechanical release packer plug assembly 30 is not a concern.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. For example, many of the features could be moved to different locations on respective parts without departing from the spirit of the invention. Furthermore, no limitations are intended to be limited to the details of construction or design herein shown, other than as described in the claims below. It is therefore evident that the particular illustrative embodiments disclosed above may be altered or modified and all such variations are considered within the scope and spirit of the present invention. Moreover, the indefinite articles "a" or "an", as used in the claims, are defined herein to mean one or more than one of the element that it introduces. Also, the terms in the claims have their plain, ordinary meaning unless otherwise explicitly and clearly defined by the patentee.

What is claimed is:

1. A mechanical release packer plug assembly comprising:

a mechanical release packer plug in a subterranean operation comprising:

a housing having a bore therethrough;

an inner sleeve disposed within the housing having a bore therethrough;

a bottom sub having a bore therethrough and coupled to a lower end of the housing;

a debris chamber with a bore therethrough, wherein an upper end of the debris chamber is coupled to a lower end of the bottom sub and wherein a lower end of the debris chamber is coupled to an end cap; and wherein the debris chamber is adapted to prevent fluid and debris from interfering with the subterranean operation; and wherein the mechanical release packer plug is adapted for running a shifting tool through the inner sleeve, wherein activation of the shifting tool disengages the inner sleeve from a packer.

2. The mechanical release packer plug assembly of claim 1, further comprising a connecting means for coupling the bottom sub to the lower end of the housing.

3. The mechanical release packer plug assembly of claim 2, wherein the connecting means comprises one or more set screws.

4. The mechanical release packer plug assembly of claim 1, wherein the bottom sub is sealingly engaged with an inner profile of the inner sleeve by a seal.

5. The mechanical release packer plug assembly of claim 4, wherein the seal comprises one or more of elastomeric o-rings.

6. A hydraulic set packer assembly for use in subterranean operations comprising:

a packer comprising a top sub, bottom sub, and a bore therethrough, the bottom sub further comprising a collet;

a mechanical release packer plug assembly comprising:

a housing having a bore therethrough;

an inner sleeve disposed within the housing having a bore therethrough;

a bottom sub having a bore therethrough and coupled to a lower end of the housing;

a debris chamber with a bore therethrough, wherein an upper end of the debris chamber is coupled to a lower end of the bottom sub and wherein a lower end of the debris chamber is coupled to an end cap;

wherein an upper end of the inner sleeve is releasably engaged with the collet thereby connecting the bottom sub of the packer to the mechanical release packer plug assembly; and wherein a lower end of the packer bottom sub is sealingly engaged with an inner profile of the inner sleeve by a seal.

7. The hydraulic set packer assembly of claim 6, further comprising a shifting tool, wherein inner dimensions of the inner sleeve and inner dimensions of the mechanical release packer plug assembly bottom sub are adapted to mate with outer dimensions of the shifting tool.

8. The hydraulic set packer assembly of claim 7, wherein the shifting tool comprises retractable keys that are adapted to fit within the inner profile of the inner sleeve and wherein upon retraction of the keys, the shifting tool is adapted to give a positive indication at the surface that the inner sleeve has been fully shifted.

9. The hydraulic set packer assembly of claim 6, wherein the mechanical release packer plug assembly further comprises a connecting means for coupling the bottom sub to the lower end of the housing.

10. The hydraulic set packer assembly of claim 6, wherein the connecting means comprises one or more set screws.

11. The hydraulic set packer assembly of claim 6, wherein a lower end of the packer bottom sub is sealingly engaged with an inner profile of the inner sleeve by a seal, and wherein the bottom sub of the mechanical release packer plug assembly is sealingly engaged with an inner profile of the inner sleeve by a seal.

12. The hydraulic set packer assembly of claim 6, wherein the seal comprises one or more of elastomeric o-rings.

13. The hydraulic set packer assembly of claim 6, wherein the debris chamber is adapted to prevent fluid and other debris from interfering with the subterranean operations.

14. The hydraulic set packer assembly of claim 6, wherein one or more shear pins releasably secure the inner sleeve to the housing.

15. The hydraulic set packer assembly of claim 14, wherein the one or more shear pins is adapted to prevent longitudinal motion between the housing and the inner sleeve until the one or more shear pins are sheared.

16. A method of plugging a well during subterranean operations comprising:

hydraulically setting a hydraulic set packer assembly in a well bore, the hydraulic set packer assembly comprising:

a packer comprising a top sub, bottom sub, and a bore therethrough, the bottom sub further comprising a collet;

a mechanical release packer plug assembly comprising:

a housing having a bore therethrough;

an inner sleeve disposed within the housing having a bore therethrough;

a bottom sub having a bore therethrough and coupled to a lower end of the housing;

a debris chamber with a bore therethrough, wherein an upper end of the debris chamber is coupled to a lower end of the bottom sub and wherein a lower end of the debris chamber is coupled to an end cap;

wherein an upper end of the inner sleeve is releasably engaged with the collet thereby connecting the bottom sub of the packer to the mechanical release packer plug assembly; and releasing the mechanical release packer plug assembly from the packer by disengaging the inner sleeve from the collet.

17. The method of claim 16, further comprising hydrostatically installing a second packer onto the upper end of the top sub of the packer of the hydraulic set packer assembly and further coupling the second packer to the top sub of the packer of the hydraulic set packer assembly by a latching mechanism.

18. The method of claim 16, further comprising running a shifting tool through the inner sleeve, wherein activation of the shifting tool disengages the upper end of the inner sleeve from the collet.

19. The method of claim 16, further comprising applying surface tubing pressure to reduce friction in the sealing means thereby disengaging the mechanical release packer plug assembly from the bottom sub of the packer.

* * * * *